US006964711B2

(12) United States Patent
Fortunati et al.

(10) Patent No.: US 6,964,711 B2
(45) Date of Patent: Nov. 15, 2005

(54) PROCESS FOR THE PRODUCTION OF GRAIN ORIENTED ELECTRICAL STEEL STRIPS

(75) Inventors: Stefano Fortunati, Rome (IT); Stefano Cicale', Rome (IT); Giuseppe Abbruzzese, Rome (IT)

(73) Assignee: Thyssenkrupp Acciai Speciali Terni S.p.A., Terni (IT)

( * ) Notice: Subject to any disclaimer, the term of this patent is extended or adjusted under 35 U.S.C. 154(b) by 22 days.

(21) Appl. No.: 10/450,969

(22) PCT Filed: Dec. 18, 2001

(86) PCT No.: PCT/EP01/14966

§ 371 (c)(1),
(2), (4) Date: Nov. 13, 2004

(87) PCT Pub. No.: WO02/50315

PCT Pub. Date: Jun. 27, 2002

(65) Prior Publication Data

US 2005/0115643 A1 Jun. 2, 2005

(30) Foreign Application Priority Data

Dec. 18, 2000 (IT) ..... RM2000A0677

(51) Int. Cl.[7] ..... H01F 1/16
(52) U.S. Cl. ..... 148/111; 148/112; 148/120; 148/121
(58) Field of Search ..... 148/110–113, 120–122

(56) References Cited

U.S. PATENT DOCUMENTS

| | | | | |
|---|---|---|---|---|
| 4,615,750 | A * | 10/1986 | Mochinaga et al. | 148/111 |
| 4,851,056 | A * | 7/1989 | Miyoshi et al. | 148/111 |
| 5,288,736 | A * | 2/1994 | Schoen et al. | 148/113 |
| 6,503,339 | B1 * | 1/2003 | Pircher et al. | 148/120 |

FOREIGN PATENT DOCUMENTS

| | | |
|---|---|---|
| EP | 0390160 | 10/1990 |
| EP | 0743370 | 11/1996 |
| WO | WO 98/10104 | 3/1998 |

* cited by examiner

*Primary Examiner*—John P. Sheehan
(74) *Attorney, Agent, or Firm*—McCormick, Paulding & Huber LLP

(57) ABSTRACT

A process for the production of grain oriented electrical Fe-Si strips in which a Si-containing alloy is directly cast as a strip between 2.5–5.0 mm thick and cold rolled in one stage, or in more stages with intermediate annealing, to a final thickness of between 0.15–1.0 mm. The strip is then continuously annealed to carry out the primary recrystallization and then annealed to carry out the oriented secondary recrystallization. The process further includes that after solidification of the strip, and before its coiling, a phase transformation from Ferrite to Austenite is induced into the metal matrix for a volume fraction between 25–60%, obtained by controlling the alloy composition so that the Austenite fraction is allowed within the stability equilibrium between the two phases. The strip is then deformed by rolling in-line with the casting step to obtain a deformation higher than 20% in the temperature interval 1000–1300° C.

16 Claims, No Drawings

PROCESS FOR THE PRODUCTION OF GRAIN ORIENTED ELECTRICAL STEEL STRIPS

CROSS-REFERENCE TO RELATED APPLICATIONS

This application is entitled to the benefit of and incorporates by reference in their entireties essential subject matter disclosed in International Application No. PCT/EP01/14966 filed on Dec. 18, 2001 and Italian Patent Application No. RM2000A000677 filed on Dec. 18, 2000.

FIELD OF THE INVENTION

Present invention refers to the production of grain oriented electrical steel strips havig, excellent magnetic characteristics, dedicated to the production of transformer cores. More precisely, the invention refers to a process in which a Fe-Si alloy is continuously cast directly as strip and, before coiling, the strip itself is continuously deformed by rolling to induce the formation in the metal matrix of a given fraction of Austenite, controlled as amount and distribution, thus obtaining a strip micro-structure stably and uniformly recrystallised before cold rolling.

BACKGROUND OF THE INVENTION

Grain oriented electrical steel strips (Fe-Si) are typically industrially produced as strips having a thickness comprised between 0.18 and 0.50 mm and are characterised by magnetic properties variable according to the specific product class. Said classification substantially refers to the specific power losses of the strip subjected to given electromagnetic work conditions (e.g. $P^{50Hz}$ at 1.7 Testa, in W/kg), evaluated along a specific reference direction (rolling direction). The main utilisation of said strips is the production of transformer cores. Good magnetic properties (strongly anisotropic) are obtained controlling the final crystalline structure of the strips to obtain all, or almost all, the grains oriented to have their easiest magnetisation direction (the [001] axis) aligned in the most perfect way with the rolling direction. In practice, final products are obtained having the grains mean diameter generally comprised between 1 and 20 mm having an orientation centred around the Goss orientation ({110}[001]). The minor the angular dispersion around the Goss one, the better the product magnetic permeability and hence the lesser the magnetic losses. The final products having low magnetic losses (core losses) and high permeability have interesting advantages in terms of design, dimensions and yield of the transformers.

The first industrial production of the above materials was described by the U.S. Firm ARMCO at the beginning of the thirties (U.S. Pat. No. 1,956,559). Many important improvements have been since introduced in the production technology of grain oriented electrical strips. In terms both of magnetic and physical quality of products and of transformation costs and cycles rationalisation. All existing technologies exploit the same metallurgical strategy to obtain a very strong Goss structure in the final products, i.e. the process of oriented secondary recrystallisation guided by uniformly distributed second phases and/or segregating elements. The, non metallic, second phases and the segregating elements play a fundamental role in controlling (slowing down) the movement of grain boundaries during the final annealing which actuates the selective secondary recrystallisation process.

In the original ARMCO technology, utilising MnS as inhibitor of the grain boundaries movement, and in the subsequent technology developed by NSC, in which the inhibitors are mainly aluminium nitrides (AlN+MnS) (EP 8.385, EP 17.830, EP 202.339), a very important binding step common to both production processes is the heating of the continuously cast slabs (ingots, in old times), immediately before the hot rolling, at very high temperatures (around 1400° C.) for a time sufficient to guarantee a complete dissolution of sulphides and/or nitrides coarsely precipitated during the slab cooling after casting, to re-precipitate them in a very fine and uniformly distributed form throughout the metallic matrix of the hot rolled strips. Such a fine re-precipitation can be started and, completed, as well as the precipitates dimensions adjusted, during the process, in any case, however, before the cold rolling. The slab heating to said temperatures requires using special furnaces (pushing furnaces, liquid-slag walking-beam furnaces, induction furnaces) due to the ductility at high temperatures of the Fe-3% Si alloys and to formation of liquid slags.

New casting technologies of the liquid steel are intended to simplify the production processes to make them more compact and flexible and to reduce costs. One of said technologies is the "thin slab" casting, consisting in the continuous casting of slabs having the typical thickness of conventional already roughened slabs, apt to a direct hot rolling, through a sequence of slabs continuous casting, treating in continuous tunnel-furnaces to rise/maintain the temperature of slabs and finishing-rolling, down to coiled strip. The problems connected to the utilisation of said technique for grain oriented products mainly consist in the difficulty to maintain and control the high temperatures necessary to keep in solution the elements forming the second phase, which have to be finely precipitated at the beginning of the finishing hot-rolling step, if desired best micro-structural and magnetic characteristics are to be obtained in the end-products. Such problems were dealt with in different ways, for instance utilising the low thickness of the cast slabs in connection to specific concentration intervals of the micro-alloying elements to stably control the second phases precipitation (grain growth inhibitors) during hot rolling, or drastically modifying the strategy of the inhibitors formation in the metal matrix.

The casting technique potentially offering the highest rationalisation level of the processes and the higher production flexibility is the one consisting in the direct production of strips from the liquid steel (Strip Casting), totally eliminating the hot rolling step. Such an exaordinary innovation was conceived and patented long time ago, and since long time were also devised and patented process conditions to produce electrical steel strips, and more particularly grain oriented ones. However, up to now there is not an industrial production in the world of grain oriented electrical steel according to the above technique, though the state of the art relating to the casting machines is ready for industrial applications, as shown by existing plants, producing only carbon steels and stainless steels.

The present inventors believe that to industrially produce grain oriented electrical steel strips from direct solidification of a strip (Strip Casting) it is necessary to have a strip micro-structure before cold rolling significantly different from the one obtained during the casting stage. The high solidification speed of the cast strip makes it difficult to have a homogeneous and reproducible grain structure throughout the strip and between different castings, due to the high sensitivity of the solidification structure to the fluctuations of the casting conditions and to the alloy composition. The micro-structure of the intermediate products starting from strip casting is much more influenced by the solidification structure, with respect to the ones derived from conventional slab casting, because of the lack of deformation in the strip during the typical hot rolling.

SUMMARY OF THE INVENTION

The aim of present invention is to solve the inconveniences due to the quality of electrical steel strips deriving from strip casting. Thus, it is an object of present invention a process for the production of electrical steel strips in which, through an in-line thickness reduction of the strip between casting and coiling stations, a significant level of recrystallisation by means of phase transformation is induced, thus normalising the crystalline structure before cold rolling, so that possible fluctuations in the process conditions are substantially non-influent with respect to the quality of the final product.

Another object of present invention is to make it possible to industrially produce grain oriented electrical steel strips having excellent magnetic characteristics and constant quality, the process being stable and simplyfied with respect to the conventional processes currently utilised.

Further objects of present invention will be evident from the following description of the invention.

DETAILED DESCRIPTION OF THE INVENTION

A first important aspect of present invention resides in that a molten alloy containing silicon is directly solidified in the form of a strip, through the casting technology known as strip casting (casting between twin cooled and counter-rotating rolls), thus avoiding, with respect to currently utilised technologies, casting the alloy in slabs or ingots, subjecting said slabs to thermal treatment in special high-temperature furnaces for long times (to attain the necessary thermal homogeneity) and transforming said slabs into strips through hot rolling with total reductions which, according to the slab casting technologies, vary between 96 and 99%.

A second important aspect of present invention resides in that the chemical composition of the Silicon containing alloy is selected specifically to control the thermodynamic stability of the Austenite phase in the matrix (face-centered cubic lattice) in equilibrium with the Ferrite phase (body-centered cubic lattice). More precisely, to obtain excellent final magnetic characteristics, it is convenient to adjust the chemistry of the alloy so that an Austenite fraction comprised between 25 and 60% is stable between 1100 and 1200° C. Consequently, to balance the strong tendency of silicon to stabilise the Ferrite phase, a number of elements are utilised, favouring the Austenite formation. Aming those elements, Carbon is particularly important due to its intrinsic austenitising effect as well as to its particular mobility into the matrix, making it possible its easy elimination by means of solid-state decarburising processes which, in this field, are usually carried out by extraction from the strip surfaces utilising annealing atmospheres having a controlled oxidising potential. The carbon is conveniently present in the steel composition in amount apt to control the desired Austenite fraction, in that in this way it is possible to rise again the stability of the Ferrite by means of a simple decarburisation process, and thus avoiding during the final secondary recrystallisation annealing important phase transition phenomena which would be detrimental for the final desired texture. As known, however, in said materials it is necessary to reduce the carbon content in the final products at levels of under 50 ppm, to eliminate the adverse effect on the core losses due to formation of carbides. The higher the carbon content of the alloy, the longer the time necessary to carry out the decarburisation. For productivity reasons, it is then convenient to keep the carbon content within a maximum of 0.1 wt %. Present inventors evaluated the obtainable Austenite fractions according to different alloy compositions both experimentally and according to empirical relationships available in the literature.

A third aspect of the invention resides in that the Derrite to Austenite transformation in the metal matrix of the cast strip is induced, in a temperature interval centered around 1150° C., typically 1000–1300° C., by means of a sudden deformation higher than 20%, by rolling between cooled rolls, in-line with the continuous casting and before the coiling. Said sudden and localised deformation imparts to the material the energy necessary to nucleation and formation of the Austenite phase in the matrix, which phase would not be obtained for kinetic reasons, though thermodynamically very stable. In fact, to obtain equilibrium conditions between the two phases at the considered temperature very long times are necessary, while the working and cooling times are intrinsecally very short, particularly in the case of direct casting as strip (strip casting).

The phase transformation from Ferrite to Austenite is tunable, according to present invention, in quantity, according to selection of chemical composition, and consistently reproducible, as necessary in an industrial process. As a consequence of the phase transformation induced in the temperature interval defined according to present invention, the grains distribution in the produced strip, in terms both of dimensions and of texture, is extremely homogeneous and reproducible through the whole geometrical profile of the strip. This, in particular, solves the problem the drawback of micro-structural etereogeneity, typical of the production of oriented grain steel strips, in that the selection process of the final texture is sensible even to small local differences in the structure and orientation of grains, and even more sensible in the case of strip-cast products. In fact, in the traditional processes the strip structure before cold rolling is the result of a strong hot deformation of the cast slabs, which contributes to fragment, recrystallise and homogenise the solidification structure, on the contrary, in the strips obtained by direct solidification the structure directly depends on the solidification one, and due to the high solidification speed and to the strongly dynamic nature of the process any even small fluctuation of the casting conditions (such as strip thickness, casting speed, heat transfer to the casting rolls, etc.) can induce local variations, periodic or random, in the solidification structure and therefore in the final strips micro-structure throughout its geometrical profile.

The process of the invention overcomes the drawbacks inherent in the directly cast steel strips, due to lack of high hot deformation levels refining and homogenising the micro-structure. Said high deformation levels are typical of technologies based on conventional casting, and in present invention are very efficiently replaced by causing a controlled, as amount and distribution, phase transformation Ferrite to Austenute, able to refine and homogenise the micro-structure.

The high solification speeds proper of strip casting are also an important metallurgical opportunity to exploit in the best way the process according to present invention. In fact, in the traditional technologies starting from slabs or ingots the Ferrite/Austenite transformation, if any, is localised in chemical segregation zones, in which austenitising elements are concentrated, particularly in the semi-products core. Thus, in said zones the austenitic transformation can occur, due to local concentration of austenitising elements, even if the mean chemical composition of the steel would not consent it. On the contrary, in the strip casting the high solidification speeds strongly limit the segregating phenomena, thus making homogeneous in the matrix the distribution of austenitising elements. In said conditions, by hot rolling in the prescribed temperature field, it is obtained in a stable and reproducible way the volumetric fraction of Austenite, defined by chosing the steel composition, throughout the whole geometrical profile of the strip.

A further element of present invention if the definition of a process utilising a controlled volumetric fraction of Austenite, induced within the strip as above defined, to obtain a controlled distribution of hard phases (Carbides, Cementite, Pearlite, Bainite) and to control the formation of some Martensite (tetragonal lattice) within the metal matrix, by quenching the strip between the in-line hot rolling and the coiling steps. The presence of homogeneously distributed hard phases (quenching phases) permits the cold rolling to control the adequate deformation texture, clearly because of the different deformation models and of the higher hardening levels obtained by cold rolling when hard phases are present with reference to the case in which a quenching structure is not present. This permits to reduce the thickness of the strip to be cold rolled (for the same final thickness) and consequently to reduce the thickness of the cast strip, with important advantages on the casting productivity. In fact, the thinner the cast strip, the higher the casting productivity, in that the strip becomes longer in direct proportion to the thickness reduction, while the casting speed rises with the square of the thickness reduction. A further element of present invention is a process in which the strip, after in-line deformation, is kept at a temperature around 1150° C., typically 1100–1200° C., for at least 5 s, utilising a continuous heating apparatus between the in-line rolling mill and the coiler. This can be obtained for instance a heating chamber provided with burners, or with electric heating, or with infrared lamps, or with an induction-heating apparatus; however, any active or passive system apt to obtain the desired strip temperature in the prescribed interval and for at least 5 s. In this case, the optional quenching step will be carried out at the exit from said chamber.

Another aspect of present invention is a process in which the strip is annealed, before cold rolling, at temperature not exceeding 1200° C., preferably not exceeding 1170° C. Such an annealing can be advantageous for the grain oriented electrical steel strip production process, for a number of reasons, particularly with respect to the magnetic characteristics control of the final products. Some useful phenomena for the process are, for instance, the precipitation of non-metallic second phases, necessary in present products to the control of the oriented secondary recrystallisation, or the possibility to carry out a controlled surface decarburisation of the strips before the cold rolling, which can have positive effects on the texture of the cold rolled strip. Moreover, this annealing can offer the possibility to shift to this process step the formation of quenching phases, instead of forming them before coiling the strip after the casting process. In this case, at the end of the annealing furnace a suitable cooling device must be present able to reach the necessary cooling speed. For instance, the strip cooling can be usefully obtained with respect to the teaching of present invention, by means of a group of lances provided with nozzles to spray on the strip surface a mixture of water and steam, at a controlled pressure.

Typically, after the in-line rolling the strip is quenched to obtain a Martensite volume fraction comprised between 5 and 15%. The quenching device operate starting from a temperature of between 750 and 950° C., to cool down the strip down to 400° C. in less than 12 s.

A last element of present invention is a process in which the chemical composition requires the presence of element chosen between two distinct classes: (i) elements useful to control the desired equilibrium between Austenite anf Ferrite in the metal matrix and (ii) elements useful to control a second phases distribution, such as sulphides, selenides, nitrides, carbo-nitrides etc., necessary for the grain growth control and of grain orientation during the primary and secondary recrystallisation steps.

Typically, the cast steel composition comprises 2.5–5 wt % Si; 200–1000 ppm C, 0.05–0.5 wt % Mn, 0.07–0.5 wt % Cu, less than 2 wt % Cr+Ni+Mo, less than 30 ppm O, less than 500 ppm S+Se, 50–400 ppm Al, less than 100 ppm N. To this composition at least an element can be added chosen in the group consisting of Zr, Ti, Ce, B, Ta, Nb, V and Co, and at least an element chosen in the group consisting of Sn, Sb, P, Bi.

Many are the elements useful to the equilibrium control between Austenite and Ferrite phases and there are no specific choice limitations, but cost and yield convenience. However, and specifically in electric-furnace steel shops utilising steel scraps as raw material, it can be convenient to balance the content of silicon as well as of chromium, nickel, molybdenum, niobium, copper, manganese and tin.

Many are also the elements useful to control the distribution of second phases particles for the grain growth inhibition. It is convenient to chose said elements among the ones able to form suphides, selenides, carbonitrides, nitrides, to obtain a mix of second phases having different composition in which co-exist compounds thermally stable, as solubility, at different temperatures. As a consequence of this choice, the drag force of the grain boundaries movement due to second phases particles gradually diminishes as temperature rises, in that during the heat treatments the more soluble particles will dissolve and/or grow before the less soluble ones. This permits a better control of grain growth, with respect to the utilisation of inhibitors of a single composition type characterised by a narrower solubilisation temperatures interval.

The following Examples are intended solely to illustration purposes not limiting the scope of present invention.

EXAMPLE 1

A number of steels having the compositions shown in Table 1 were cast as a strip 3.5 mm thick in a strip casting machine provided with twin counter-rotating rolls. The cast strips were then in-line hot rolled at the temperature of 1150° C. to a 2.0 mm thickness. During the casting operation of each steel composition and at about mid casting time, the cast strip thickness was reduced to 2.0 mm and the in-line rolling suspended. The hot rolled strips were then annealed at 1100° C. and single-stage cold rolled to 0.30 mm.

TABLE 1

| Steel | C (ppm) | Si (%) | Mn (%) | S (ppm) | Cr (ppm) | Ni (ppm) | Al (ppm) | Cu (ppm) |
|---|---|---|---|---|---|---|---|---|
| A | 500 | 3.1 | 0.2 | 75 | 300 | 100 | 250 | 0.1 |
| B | 300 | 3.1 | 0.1 | 68 | 350 | 120 | 270 | 0.15 |
| C | 350 | 3.2 | 0.4 | 70 | 320 | 110 | 230 | 0.3 |
| D | 400 | 3.1 | 0.3 | 80 | 290 | 150 | 280 | 0.25 |
| E | 500 | 3.1 | 0.4 | 50 | 400 | 100 | 280 | 0.2 |

The cold-rolled strips were then decarburised, coated with an MgO based annealing separator, box annealed with an heating rate of 15° C./h up to 1200° C., held at this temperature for 20 h, and then received an insulating and tensioning coating. On the as-cast strips the austenite (γ phase) content at 1150° C. was calculated by means of dilatometric measures; data obtained are shown in Table 2.

TABLE 2

| Steel | γ(1150)(%) |
|---|---|
| A | 27 |
| B | 11 |
| C | 15 |
| D | 19 |
| E | 25 |

The magnetic characteristics measured on the final product for the different steel composition are shown in Table 3.

TABLE 3

| Steel | In-line hot rolled B800 (mT) | Not In-line rolled B800 (Mt) |
|---|---|---|
| A | 1950 | 1700 |
| B | 1720 | 1650 |
| C | 1730 | 1630 |
| D | 1900 | 1680 |
| E | 1945 | 1710 |

EXAMPLE 2

A number of steels having different compositions as shown in Table 4 were directly cast as strips 2.1 mm thick in a strip-casting machine provided with twin counter-rotating rolls.

TABLE 4

| Steel | C (ppm) | Si (%) | Mn (%) | S (ppm) | Cr (ppm) | Ni (ppm) | Al (ppm) | Cu (ppm) |
|---|---|---|---|---|---|---|---|---|
| A | 550 | 3.3 | 0.3 | 80 | 450 | 200 | 280 | 0.15 |
| B | 300 | 3.1 | 0.2 | 68 | 350 | 120 | 270 | 0.2 |
| C | 350 | 3.2 | 0.4 | 70 | 320 | 130 | 230 | 0.3 |
| D | 400 | 3.0 | 0.3 | 80 | 290 | 180 | 280 | 0.25 |
| E | 400 | 3.1 | 0.4 | 75 | 250 | 200 | 290 | 0.25 |

The cast strips were then in-line hot rolled at 1170° C. to a thickness of 1.0 mm, quenched by means of water and steam at high pressure down to a temperature of 150° C. and then coiled. After casting about half of the steel the quenching was stopped and the strips wound at 700° C.

Table 5 shows the Martensite fractions metallographically measured on the strip after coiling.

TABLE 5

| Steel | Quenched strip Martensite (%) | Not-quenched strip Martensite (%) |
|---|---|---|
| A | 19 | 0 |
| B | 3 | 0 |
| C | 5 | 0 |
| D | 13 | 0 |
| E | 15 | 0 |

The strips were then divided into lesser coils, part of which were cold rolled to 0.3 mm (the casting A did show fragility problems during cold rolling and was not transformed into finished product), decarburised, coated with an MgO based annealing separator, then box annealed with a heating rate of 20° C./h up to 1200° C. and then held at this temperature for 20 h. Table 6 shows the magnetic characteristics (induction at 800 A/m) measured on the finished product.

TABLE 6

| Steel | Quenched strip B800 (mT) | Not-quenched strip B800 (mT) |
|---|---|---|
| A | — | 1830 |
| B | 1790 | 1650 |
| C | 1890 | 1630 |
| D | 1920 | 1820 |
| E | 1950 | 1830 |

EXAMPLE 3

The other lesser rolls of Example 2 without quenching and coiled at 700° C. were annealed at 1150° C. for 60 s, quenched by means of water and steam at high pressure down to 150° C., pickled and coiled at room temperature. The strips were then transformed into finished product as in preceding Example. Table 7 shows the Martensite fractions measured on the coiled strips and relevant magnetic characteristics.

TABLE 7

| Steel | Martensite (%) | B800 (mT) |
|---|---|---|
| A | 12 | 1950 |
| B | 2 | 1700 |
| C | 5 | 1740 |
| D | 8 | 1920 |
| E | 9 | 1920 |

EXAMPLE 4

Five different alloys of composition (in ppm) shown in Table 8 were cast directly as strips 2.2–2.4 mm thick in a casting machine with twin counter-rotating rolls.

TABLE 8

| | Si | C | Mn | Cu | Sn | Cr | Mo | Nb | Ni | P | Al | Ce | N | S |
|---|---|---|---|---|---|---|---|---|---|---|---|---|---|---|
| A | 3.2 | 0.07 | 0.40 | 0.25 | 0.1 | 0.03 | 0.1 | 0.03 | 0.02 | — | 0.030 | 0.01 | 0.01 | 0.010 |
| B | 3.3 | 0.06 | 0.06 | 0.07 | — | 0.09 | 0.03 | — | 0.03 | — | 0.004 | — | 0.007 | 0.025 |
| C | 3.0 | 0.03 | 0.95 | 0.40 | 0.06 | 0.30 | 0.02 | 0.02 | 0.20 | 0.02 | 0.015 | — | 0.007 | 0.015 |
| D | 3.1 | 0.05 | 0.15 | 0.25 | — | 0.02 | 0.03 | — | 0.02 | — | 0.028 | — | 0.008 | 0.007 |
| E | 3.4 | 0.07 | 0.40 | 0.35 | — | 0.03 | 0.05 | 0.01 | 0.03 | 0.01 | 0.030 | — | 0.008 | 0.006 |

TABLE 9

| Decarburation. T (° C.) | A1 | B1 | C1 | D1 | E1 | A2 | B2 | C2 | D2 | E2 |
|---|---|---|---|---|---|---|---|---|---|---|
| 830 | 1890 | 1800 | 1920 | 1930 | 1910 | 1690 | 1520 | 1730 | 1640 | 1580 |
| 850 | 1930 | 1750 | 1940 | 1910 | 1920 | 1730 | 1540 | 1780 | 1540 | 1630 |
| 870 | 1940 | 1590 | 1890 | 1900 | 1890 | 1780 | 1530 | 1690 | 1520 | 1540 |

The cast steels were in-line hot rolled at 1150° C. to a thickness of 1.2 mm. From said coiled strips were obtained lesser coils. For each condition a strip was then double-stage annealed with quick heating to 1170° C., cooling at 1100° C. and quenched to room temperature with water plus steam jets (strips A1, B1, C1, D1, E1). A second group of strips, similar the the previous one, was annealed with a similar thermal cycle, without however the quenching step (strips A2, B2, C2, D2, E2). All the strips were then single-stage cold rolled to a final thickness of 0.29 mm. The strips were then treated in a continuous pilot line for primary recrystallisation, nitriding, secondary recrystallisation. Each strip was then treated as follows:

- in the first treating zone (primary recrystallisation) the temperatures of 830, 850 and 870° C. were adopted, in a wet Nitrogen-Hydrogen atmosphere with a $pH_2O/pH_2$ ratio of 0.60 and for 180 s (50 of which for the heating at treating temperature)
- in the second treating zone nitriding was carried out at 890° C. in wet Nitrogen-Hydrogen atmosphere with a $pH_2O/pH_2$ ratio of 0.09, with the addition of 30% vol of ammonia, for 50 s
- in the third zone, at 1100° C. in a wet Nitrogen/Hydrogen atmosphere with a $pH_2O/pH_2$ ratio of 0.01 for 50 s.

After coating with an Mg/O based annealing separator the strips treated in the pilot line were then box annealed with a heating rate of about 60° C./h up to 1200° C. in a 50% Nitrogen-Hydrogen atmosphere, held at this temperature for 3 h in pure hydrogen and cooled down to 800° C. in hydrogen and subsequently to room temperature in nitrogen.

The magnetic characteristics measured on samples of each of said strips were measured as induction mean value B800 in mT, and are shown in Table 9.

What is claimed is:

1. A process for the production of electrical grain oriented Fe-Si strips in which a Si-containing molten alloy composition is directly cast as continuous strips 2.5 to 5 mm thick, cold rolled in one step or more steps with intermediate annealing to a final thickness of between 1 and 0.15 mm, the strip being then continuously annealed to carry out oriented secondary recrystallisation, characterised in that after the strip solidification and before coiling of said strip in a coiling phase, a ferrite to austenite transformation is induced in the metal matrix via deformation, by rolling said strip between two cooled rolls to obtain a deformation over 20% in a temperature range of 1000–1300° C., thereby producing a volume fraction of austenite to be between 25 and 60%, said molten alloy composition being chosen such that said volume fraction of austenite is stable in a temperature interval of between 1100 and 1200° C.

2. The process according to claim 1, in which between the rolling phase and the coiling one, the strip is held between 1100 and 1200° C. for at least 5 s.

3. The process according to claim 1, in which the as-solidified strip thickness is comprised between 1.5 and 4.0 mm and after the rolling phase the strip is quenched to obtain a volume fraction of martensite comprised between 5 and 15%.

4. The process according to claim 1, in which before cold rolling the strip is annealed at a maximum temperature of 1200° C.

5. The process according to claim 4, in which after said annealing the strip is continuously quenched from a temperature comprised between 750 and 950° C. down to 400° C. in less than 12 s.

6. The process according to claim 1, in which the cast alloy comprises 2.5–5.0 wt % Si, 200–1000 ppm C, 0.05–0.5 wt % Mn, 0.07–0.5 wt % Cu, less than 2 wt % Cr+Ni+Mo, less than 30 ppm O, less than 500 ppm S+Se, 50–400 ppm Al, less than 100 ppm N.

7. The process according to claim 1, in which in the alloy at least an element is added chosen in the group consisting of Zr, Ti, Ce, B, Ta, Nb, V, Co.

8. The process according to claim 1, in which in the alloy at least an element is added chosen between Sn, Sb, P, Bi.

9. A process for the production of grain oriented electrical Fe-Si strip, in which a Si-containing alloy is directly cast as continuous strip 2.5 to 5 mm thick, in-line hot-rolled and then cold-rolled in one step or more steps, with intermediate annealing, to a final thickness of between 1 and 0.15 mm, the cold-rolled strip being then continuously annealed to carry out primary recrystallisation and subsequently again annealed to carry out secondary recrystallisation, characterized in that the Si-containing alloy composition is selected to induce in the alloy, during the hot-rolling step in which a deformation rate of at least 20% is utilized in a temperature interval of between 1000 and 1300° C., a ferrite to austenite phase transformation with an austenite volume fraction of between 25 to 60% stable in a temperature interval of between 1100 to 1200° C.

10. The process according to claim 9, in which between the hot-rolling and the coiling steps the strip is held in the temperature range of 1100 to 1200° C. for at least 5 s.

11. The process according to claim 9, in which an as-cast strip 2.5 to 4 mm thick is in-line hot-rolled and the thus obtained hot-rolled strip is quenched to obtain a volume fraction of martensite comprised between 5 and 15%.

12. The process according to claim 9, in which before cold-rolling the strip is annealed at a maximum temperature of 1200° C.

13. The process according to claim 12, in which, after said annealing, the strip is continuously quenched from a temperature of between 750 and 950° C. down to 400° C. in less than 12 s.

14. The process according to claim 9, in which the cast alloy comprises 2.5–5.0 wt % Si, 200–1000 ppm C, 0.05–0.5 wt % Mn, 0.07–0.5% Cu, less than 2.0% Cr+Ni+Mo, less than 30 ppm O, less than 500 ppm S+Se, 50–400 ppm Al, less than 100 ppm N.

15. The process according to claim 14, in which in the alloy at least an element is added chosen in the group consisting of Zr, Ti, Ce, B, Ta, Nb, V, Co.

16. The process according to claim 14, in which in the allot at least an element is added chosen between Sn, Sb, P, Bi.

* * * * *